US007827897B2

(12) United States Patent
Magnusson et al.

(10) Patent No.: US 7,827,897 B2
(45) Date of Patent: Nov. 9, 2010

(54) LIGHT BALLISTIC PROTECTION AS BUILDING ELEMENTS

(75) Inventors: Björn Magnusson, Skara (SE); Lars-Olov Wallerman, Karlsborg (SE); Anders Karlström, Göteborg (SE); Lars Jacobsson, Åsa (SE); Henric Rhedin, Lerum (SE)

(73) Assignee: Protaurius Aktiebolag, Goteborg (SE)

( * ) Notice: Subject to any disclaimer, the term of this patent is extended or adjusted under 35 U.S.C. 154(b) by 724 days.

(21) Appl. No.: 11/720,340

(22) PCT Filed: Dec. 20, 2005

(86) PCT No.: PCT/SE2005/001988

§ 371 (c)(1),
(2), (4) Date: Jul. 9, 2007

(87) PCT Pub. No.: WO2006/068605

PCT Pub. Date: Jun. 29, 2006

(65) Prior Publication Data

US 2008/0006146 A1 Jan. 10, 2008

(30) Foreign Application Priority Data

Dec. 20, 2004 (SE) ..... 0403079

(51) Int. Cl.
*F41H 5/04* (2006.01)

(52) U.S. Cl. ..... 89/36.02

(58) Field of Classification Search ..... 89/36.02, 89/36.04, 36.05, 36.09
See application file for complete search history.

(56) References Cited

U.S. PATENT DOCUMENTS 1,463,498 A * 7/1923 Burgess ..... 109/81

(Continued)

FOREIGN PATENT DOCUMENTS

DE 19928370 A1 1/2001

(Continued)

OTHER PUBLICATIONS

Translation of SE 0002005-7.*

(Continued)

*Primary Examiner*—Troy Chambers
(74) *Attorney, Agent, or Firm*—Jeffrey S. Melcher; Manelli Denison & Selter PLLC

(57) ABSTRACT

The present invention concerns a ballistic protection against objects such as projectiles from fire arms, alternatively scatter from for example hand grenades. The protection comprises an enclosure (1, 2, 4, 5, 6, 7, 9) adapted so that the object (10) can penetrate the enclosure (1, 2, 4, 5, 6, 7, 9) in at least one area (2); at least one intermediate layer (3) comprising granules (27) arranged within the enclosure (1, 2, 4, 5, 6, 7, 9), which intermediate layer (3) and enclosure (1, 2, 4, 5, 6, 7, 9) are arranged to decelerate said object (10). The invention is further characterized in that: the granules (27) are movable arranged with respect to each other; the space in the intermediate layer (3) that is not occupied by granules (27) is filled by a gas medium to enable contact between adjacent granules (27); the granules (27) have mechanical properties so that a granule (27) is crushed and spread in the intermediate layer (3) when it is hit by an object (10), at the same time as adjacent granules (27) are subjected to impulses with a subsequent energy dissipation so that the object and fragments thereof remains in the protection with a reduced risk for ricochets.

22 Claims, 15 Drawing Sheets

U.S. PATENT DOCUMENTS

| | | | | | |
|---|---|---|---|---|---|
| 2,348,130 | A | * | 5/1944 | Hardy, Jr. | 109/84 |
| 2,391,353 | A | * | 12/1945 | Sheridan | 428/682 |
| 2,738,297 | A | * | 3/1956 | Pfistershammer | 428/117 |
| 3,228,361 | A | * | 1/1966 | Ritter | 109/84 |
| 3,232,017 | A | * | 2/1966 | Prusinski et al. | 52/309.9 |
| 3,431,818 | A | | 3/1969 | King | |
| 3,969,563 | A | * | 7/1976 | Hollis, Sr. | 428/175 |
| 5,025,707 | A | * | 6/1991 | Gonzalez | 89/36.17 |
| 5,087,516 | A | * | 2/1992 | Groves | 428/323 |
| 5,723,807 | A | * | 3/1998 | Kuhn, II | 89/36.02 |
| 5,866,839 | A | * | 2/1999 | Ohayon | 89/36.08 |
| 6,732,628 | B1 | * | 5/2004 | Coburn et al. | 89/36.02 |
| 6,808,178 | B1 | * | 10/2004 | Sovine | 273/410 |
| 7,213,497 | B1 | * | 5/2007 | Garcia et al. | 89/36.02 |
| 7,383,761 | B2 | * | 6/2008 | Warren et al. | 89/36.02 |
| 7,628,104 | B2 | * | 12/2009 | Warren et al. | 89/36.02 |
| 2002/0088339 | A1 | * | 7/2002 | Koffler | 89/36.02 |
| 2007/0006723 | A1 | * | 1/2007 | Waddell et al. | 89/36.02 |
| 2008/0141852 | A1 | * | 6/2008 | Warren et al. | 89/36.02 |

FOREIGN PATENT DOCUMENTS

| | | | | |
|---|---|---|---|---|
| EP | 0897097 | A2 | | 2/1999 |
| GB | 2149482 | A | * | 6/1985 |
| SE | 0002005 | A1 | | 11/2001 |
| WO | 0192810 | A1 | | 12/2001 |

OTHER PUBLICATIONS

Chinese Office Action Search Report (translated in English).

* cited by examiner

LIGHT BALLISTIC PROTECTION AS BUILDING ELEMENTS

This application is a national stage entry filed under 35 U.S.C. §371 of PCT/SE2005/001988, filed 20 Dec. 2005. This application also claims priority to Swedish Patent Application No. SE 0403079-7, filed 20 Dec. 2004.

TECHNICAL AREA

The present invention concerns a ballistic protection against objects such as projectiles from fire arms; alternatively scatter from for example hand grenades.

The invention comprises flexible and movable protection walls, which can be modularized depending on the desired protection. The protection will find use as permanent as well as movable protection shelters, sub-component in bullet proof containers and movable command centers and also as protective floors and side protection in transport planes and vehicles as well as protective space delimiters in hazardous workrooms and as construction elements in larger building structures.

PRIOR ART

It has been known for a long time that ballistic protection and walls of different kinds have found their natural form for different fortress constructions. These constructions were stationary, but temporary and semi-stationary protections have also been manufactured. Even mobile protections with similar function have been produced since scatter damages and direct hits of projectiles have been and still is the foremost cause to soldiers and civilians being injured. Mobile protections will also find areas of use as temporary covers of buildings with great cultural significance. Great efforts have also been made to develop different body-near protections against scattered and projectiles. In the medieval Japan silk was used as protective material in armors and it has been told that as late as 1914 a silk vest was carried by the archduke Franz Ferdinand of Austria when he was killed. However, the development has proceeded and today one focuses mainly on developing light soft protections that are adapted for soldiers and do not reduce the mobility. The progress within the fiber area has been important in this development and it has led to an increasing market breakthrough for new materials with dynamic mechanical properties, such as aramide fiber and polythene fiber. Even light and hard fiber-based materials have been used in helmets and as protective materials for light combat vehicles.

Stationary, semi-stationery or movable protection is usually classified as thin and thick protections respectively. The protection is based on different protective principles and they have different advantages and disadvantages.

Typical thin protections are based on:

a) hard plates, for example armored plates or other metals that protects through a high resistance against punching. The advantages with these protections are that they have effect against soft projectiles and that they occupy a small volume. The disadvantages are that they do not protect against projectiles with a hard core, so called armor-breaking ammunition, unless the thickness of the protection is considerably increased. However, this affects the weight in a negative way, b) fiber composites that protects by a high inter-laminar breaking tenacity. Combinations wherein a trans-laminar reinforcement is introduced can also be found on the market, i.e. the reinforcement is given a component in a direction perpendicular to the armoring layers so that the layers are bonded to each other thereby. The advantages with is protection are that it effectively protects against soft projectiles and that it has a low weight. The disadvantages with these protections are that they do not protect against projectiles with a hard core, and that they are usually based on fairly expensive fiber materials manufactured by for example 3D-weaving, 3D-braiding, stitch bonding (stitching) or short-fiber insertion. In addition, effective protections usually demand combinatory solutions with fiber-based and ceramic materials, c) ceramics that protects by high strength and hardness. The advantage with these materials is that they are comparably effective against projectiles with a hard core. The disadvantages with these protections are that they are usually expensive, heavy and relatively brittle; and they usually demand combinations with for example fiber composites for a practical handling.

Typical thick protections are often based on sand or concrete that protects by a de-acceleration of the projectile or scatter. These protections are price-worthy but very heavy and bulky, which makes it difficult to mount and dismount the protections.

Combinations of the protective methods above have also been used, for example as wearable body protection, despite the fact that the penetration ability of the projectiles usually results in an increased thickness and thereby in an increased weight.

Common for the thin protections is that there has to be very fast de-acceleration of the projectile with large energy dissipation under a short time at a hit to prevent that the protections are not penetrated with through-holes. Hence, the protections must be able to operate against the projectiles when they are as most effective, i.e. when the projectiles have a high velocity and when the tip of the projectiles is directed towards the protection. Projectiles with a hard core will therefore demand a thicker and a more firm protection, which will affect the movability of the user in cases where body-near protection is used.

Another problem with thin protections is that they have difficulties to handle a de-acceleration of projectiles that hit at the same point on the protection.

Common for the thick protections mentioned above is that they operate with a slower de-acceleration and the de-acceleration is mostly depending on the mass and velocity of the projectile. The projectile will be deaccelerated in different ways depending on the density and the properties of the protection and the construction of the projectile.

Jacket ammunition (hunting ammunition) transfer its kinetic energy to the thick protection through a deacceleration of the projectile and the deacceleration depends on the material that the protection is built of.

Full metal jacket ammunition (military ammunition and sporting ammunition) may penetrate a long distance into traditional protections based on sand, polymer mass etc and not overturn until the projectile has become instable. This has been documented in the so called humanity-surveys of ammunition performed on soft soap-materials, which additionally shows that these projectiles have a great capacity to penetrate deep in and to give a large variation in the energy dissipation pattern between different shots.

THE TECHNICAL PROBLEM

In the literature there is a vast material regarding ballistic properties of thin protections, such as woven and polymer based fiber composites. The results show that polythene fiber seems to give a better protection than aramide fiber, since the aramide fiber is brittle and therefore unable to receive loads in a damaged state without breaking. The development of new fibers such as polybenzobisoxazole fiber is still progressing, but it is characteristic for the fiber based protections that they are only concentrated on stopping projectiles by deacceleration in layer after layer. A projectile that hits a plane surface of a fiber material can rarely lose its kinetic energy by overturning or fragmentation, since the projectile is traveling straight forward, i.e. the fiber material works as a stabilizing layer around the jacket of the projectile. Instead, the task is to reduce the kinetic energy by direct deacceleration, which means that fiber based protections are usually adapted for scatter and standard ammunition.

Previous attempts to create other kinds of ballistic protections, so-called thick protections, have been documented in for instance FR 0 364 357, FR 2 649 743 and U.S. Pat. Nos. 5,723,807, 5,866,839, 3,431,818 and later on in the patent application SE 0002005-7.

In FR 0 364 357 a protection with a corrugated metal surface as protective surface (i.e. the first surface that the projectile hits) has been created to divert the projectile from its original track. A penetration of the projectile is assumed, however the purpose is to overturn the projectile towards the corrugated surface so that it uses its kinetic energy before it hits in an underlying concrete construction. The problem with this kind of construction is that the projectile is assumed to arrive to the protection at a perpendicular angle. Of course this is seldom the case, which means that the protection will have a limited protective effect. Besides, the protection may cause unwanted ricochets due to the underlying concrete construction. In addition, projectiles with a hard core do also have a demonstrated dynamic stability, which means that the projectile often fully penetrates concrete constructions with through-holes. From a design-technique perspective these corrugated surfaces also cause problems, since it is often desirable to hide the protective structure.

In FR 2 649 743 a protection has been designed wherein the penetration surface is flat and possible to penetrate. Behind the penetration surface there is an intermediate layer that comprises granules that are embedded in a fluid. The idea is that the projectile shall hit the granulate and subsequently overturn and lose kinetic energy on its way through the fluid before it stops or alternatively hits an underlying inner wall. Since it is a very strong desire to be able to affect the overturn and/or the direction change of the projectile at a minimal penetration depth, at the same time as subsequent projectiles should be able to hit the same entrance-hole without the protection being destroyed, this patent gives no solution to the problem. The fluid will leak out when the projectile hits and the ability to deaccelerate subsequent projectiles before they stop or alternatively hit the underlying wall is thereby deteriorated. In addition, the deaccelerating fluid has a negative effect on the overturn process due to its density. It should also be emphasized that this type of wall construction becomes heavy and difficult to set up.

In U.S. Pat. No. 5,723,807 a protection for vehicles is described. The protection is designed as a curtain that overturn and deflect the projectile before it hits the walls of the vehicle. The protection has a specific appearance (pattern) wherein protective string-vest shaped metal plates are assembled in a grid. The patent is primarily related to heavy vehicles and tanks with armor plates.

In U.S. Pat. No. 5,866,839 a similar protection cam be found as in U.S. Pat. No. 5,723,807, but in this case metal spheres are used to deflect and overturn the projectile. The protection has a specific appearance (pattern) wherein spheres are placed in vertical rows. The patent is also primarily related to heavy vehicles and tanks with armor plates.

In U.S. Pat. No. 3,431,818 a protection to that in FR 2 649 743 is described. In this case as well, a protection is described with a flat penetration surface that admits the projectile to pass without being substantially deformed and/or deaccelerated. The protection is also provided with an intermediate layer comprising spherical alternatively cylindrical ceramics embedded in a polymer for the purpose of creating a spatially specific stationary zigzag pattern with balls or alternatively cylinders. In the case where cylinders are used a reinforcing and stabilizing material is proposed to keep the cylinders in position. Even in this case the purpose is to facilitate the overturn of the projectile so that it is finally deaccelerated before it hits an underlying panel. Since the desire with the protection is to be able to affect the overturn of the projectile on a minimal penetration depth, at the same time as subsequent projectiles should be able to hit the same entrance hole without deteriorate the function of the protection, this means that this patent gives no solution to the problem, since the ceramic material that shall absorb the kinetic energy of the projectile is spatially fixated through the surrounding polymer mass, which deteriorates the possibility to absorb subsequent projectiles that hit the crushed ceramic balls/cylinders. In addition, the deaccelerating polymer mass between the spheres/cylinders has a negative effect on the overturn progress due to its density.

In the patent application SE 0002005-7 a similar protection is described as in U.S. Pat. No. 3,431,811 and FR 2 649 743, wherein the intermediate layer comprises a deaccelerating granulate of a suitable elastic material such as, polymer, rubber or silicone rubber. The protection operates in a similar way as the protection described in U.S. Pat. No. 3431,811, but uses an elastic material that is spatially fixated. The problem with this protection is partly that the elastic material can caught fire with smoke development as a consequence, and partly that the projectile does not overturn when it hits the same entrance hole because the elastic material is fixated in the intermediate layer. In addition, experience with other elastic materials in thin protections show, see above, that elastic materials have a predominantly deaccelerating effect and do not overturn or scatter projectile in a desired way.

None of the protective methods above offer a satisfactory protection against scatter, metal jacket and full metal jacket projectiles and ricochets in combination with good handling properties, reasonable weight and competitive prize. This is especially so with respect to projectiles with a hard core, so-called armor-breaking ammunition. To be able to design an effective ballistic protection with these properties it is required that the properties and the behavior of the projectiles against which the protection shall work are well known so that an optimal design can be proposed. Hence, there exists a very strong need to be able to affect the overturn of the projectile on a minimal penetration depth at the same time as subsequent projectiles shall be able to hit the same entrance hole without deteriorating the function of the protection. In addition, none of the protective methods above discuss how the protections shall be designed or assembled in larger building constructions, which often is of an outmost importance to prevent that soldiers and civilians are injured.

How these protections shall be designed and how the overturn, deformation, deflection and fragmentation of the projectiles shall be stimulated have consequently so far not been found out.

SUMMARY OF THE INVENTION

The invention is therefore providing a protection for stopping objects, such as projectiles from fire arms or scatter from grenades, wherein the protection comprises an enclosure being adapted so that the object can penetrate the enclosure within at least one area.

The enclosure may e.g. comprise at least one front panel adapted so that said object can pass there trough, a rear panel adapted to finally stop said object, a bottom panel, at least two side panels and an upper panel. It should be clarified that the front, rear and side panels and other panels in various embodiment of the invention can be separate units as well as a continuous unit, e.g. a pipe wherein the front and the rear side of the pipe correspond to different areas of the pipe.

The invention is also providing at least one intermediate layer comprising granules and being arranged within said enclosure, which intermediate layer and enclosure are arranged to deaccelerate said object.

The intermediated layer can e.g. be arranged between said front and rear panels or within said pipe.

The invention is particularly characterized in that:

- the granules are movable arranged with respect to each other,
- the space in the intermediate layer that is not occupied by granules is filled by a gas medium to enable contact between adjacent granules,
- the granules have mechanical properties so that a granule is crushed and spread in the intermediate layer when it is hit by an object, at the same time as adjacent granules are subjected to impulses with a subsequent energy dissipation so that the object and fragments thereof remains in the protection with a reduced risk for ricochets.

According to an embodiment of the invention a plurality of the granules have a low surface friction so as to facilitate a movement of new granules to areas wherein an object has crushed the granules that were previously occupying the area.

According to another embodiment of the invention a plurality of the granules are made of a ceramic or mineral material, which is sufficiently hard and brittle to be crushed by an impacting object and give the object an change in the centre of gravity with a subsequent increased instability that facilitates an overturn and fragmentation of the object.

According to still another embodiment of the invention a plurality of granules in the intermediate layer have a hardness that varies in different parts of the granule, e.g. varies in a direction towards the center of the granule.

According to a further embodiment of the invention a plurality of granules in the intermediate layer have a hollow core.

According to another embodiment of the invention the shape of a plurality of the granules in the intermediate layer is substantially similar to a symmetrical or asymmetrical sphere, or a prolate or oblate spherical ellipsoid so as to facilitated a mutual movement between the granules to maximize the energy dissipation of the object or its fragments.

According to still another embodiment of the invention the rear panel is made of a fiber material, e.g. a glass fiber surface covered with aramide fiber or polythene fiber.

According to an additional embodiment of the invention an underlying tensile layer is arranged behind the surface of the enclosure. The underlying tensile layer can e.g. have a corrugated structure. It is preferred that an underlying space column—e.g. an air column—is arranged behind the tensile layer.

Further advantages of the present invention and embodiments thereof will appear from the following detailed description.

DETAILED DESCRIPTION OF PREFERRED EMBODIMENTS

It has long been a desire to be able to design a ballistic protection against scatter, ricochets and other projectiles, which at the same time is easy to handle with a reasonable weight. Consequently, the main task of the invention is to design a robust deaccelerating protection for nonjacket, jacket and full jacket projectiles alternatively tracer projectiles and hand grenades that, by its comparably low mass, is easy to assemble or move if so required.

Figure 1A:
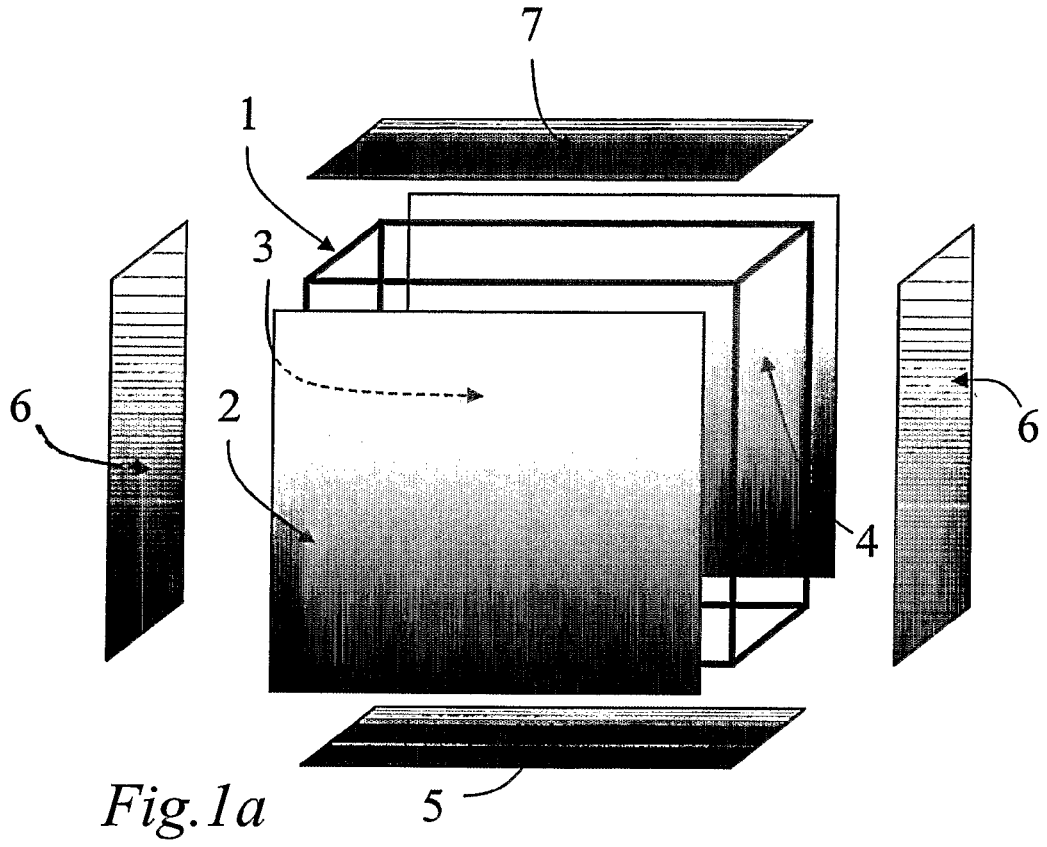
FIG. 1*a* A perspective view obliquely from the front of a sub-element in a ballistic protection.
Figure 1B:
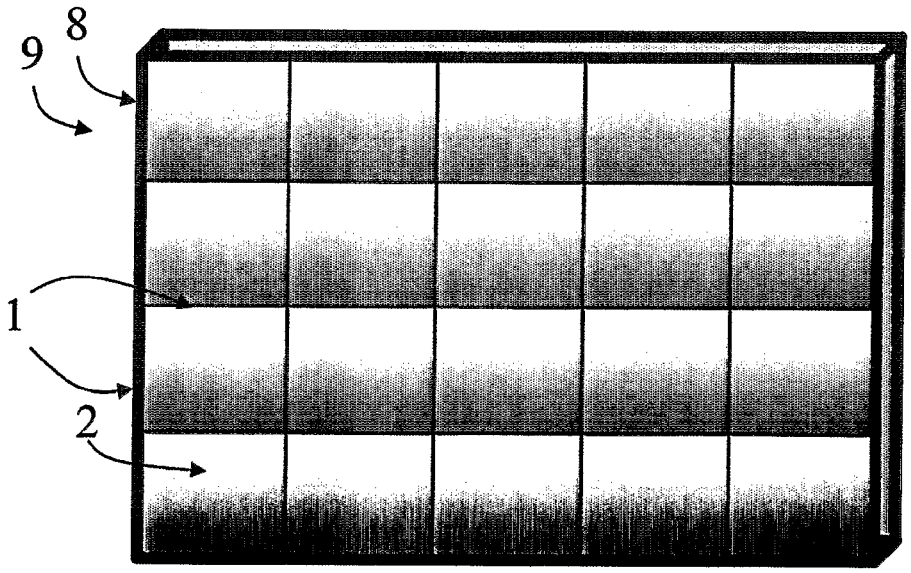
FIG. 1*b* A perspective view obliquely from the front of a building construction with sub-elements according to FIG. 1*a*.

According to the invention the design is characterized in that the ballistic protection can be shaped in accordance with FIG. 1*a* as a sub-element with a frame 1 that carries a front panel 2 through which the projectile passes, and at least an intermediate layer 3 which together with the front panel forces the projectile to deaccelerate, and a rear panel 4 that finally stops the projectile. The other panels are the bottom panel 5, two side panels 6 and an upper panel 7, which are designed in such a way that the protection can be mounted according to FIG. 1*b* as sub-elements on a frame 8 in a building structure 9 if so required.

Figure 1C:
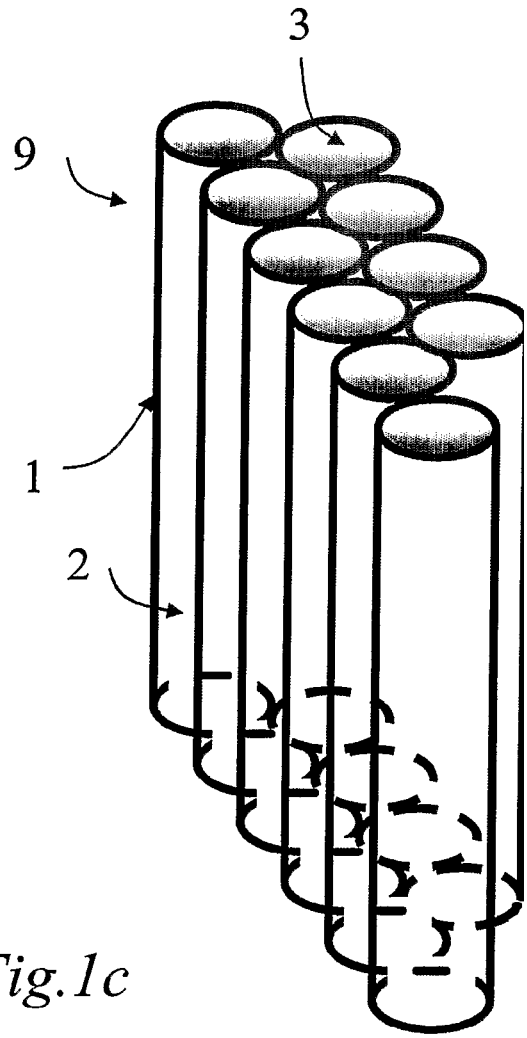
FIG. 1*c* A perspective view obliquely from the front of a building construction with pipe shaped ballistic protection elements.
Figure 1D:
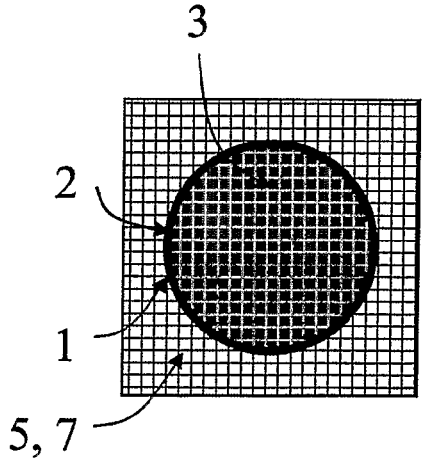
FIG. 1*d* A type of a bottom panel or alternatively an upper panel connected to a pipe shaped body.

Alternative designs, such as the one described in FIG. 1*c* wherein a pipe shaped frame 1 is shown, can in a similar way work as sub-elements in a larger building structure 9. In this case, observe that the frame 1 and the front panel 2 can be identical, unless e.g. a flat front panel as in FIG. 1*a* is used to conceal the pipe shaped surfaces. The above mentioned intermediate layer 3 that deaccelerate the projectile can be found within the pipes. In cases where the building structure can be subjected to fire the bottom panel 5 and the upper panel 7 can consist of a grating according to FIG. 1*d* with the purpose of creating a draught in the intermediate layer 3, which thereby will work as a chimney. Naturally, many different types of designs and shapes and occur but the purpose here is to exemplify combinatory applications of the protection.

Hence, the significance of the protection is that projectiles and alternatively fragments thereof remains in the protection, regardless of the entrance angle of the projectile through the front panel, which also minimizes the risk for ricochets, which is common when using e.g. concrete based protections.

Figure 1E:
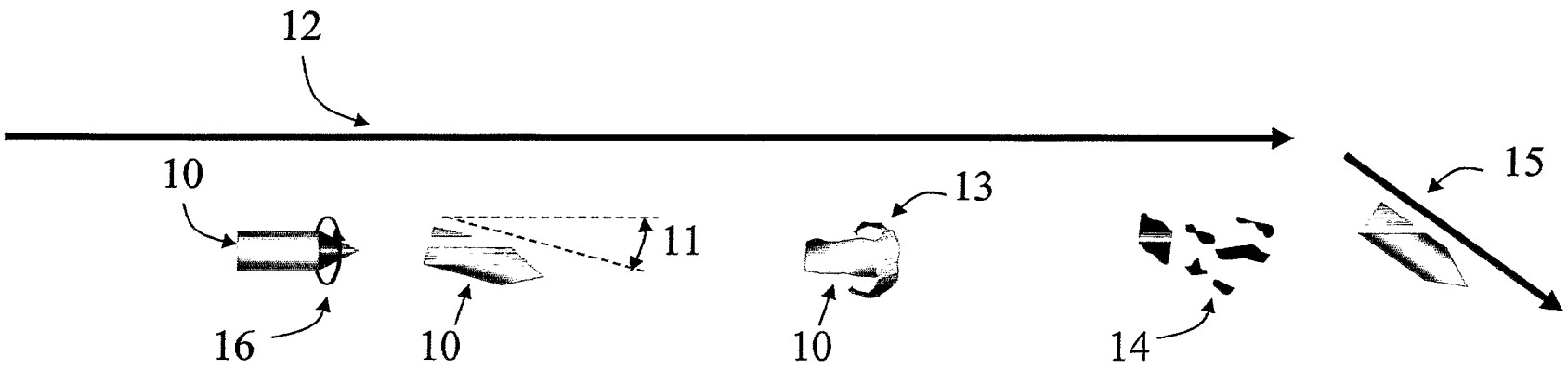
FIG. 1*e* Description of the rotation, overturn, deformation, fragmentation and direction change of projectiles.

FIG. 1*e* shows how a projectile 10 can lose its kinetic energy partly by overturning 11, which means that the projectile overturns with a certain angle but continues on its original track 12, and partly by deformation 13, which means that the projectile is deformed by for example that its' tip is compressed or ripped apart, and partly by fragmentation 14, which means that the projectile is ripped apart and divided into several pieces (scatter), and partly by changing direction 15 from its original track 12 when hitting objects without overturning, and partly in cases when the projectile has an self-rotation 16 around its own axes that causes a gyro affect when hitting a hard object resulting in an energy loss due to the occurrence of a precession and nutation movement.

However, similar arrangements are known through the above mentioned patents U.S. Pat. No. 3,431,818 and FR 2 649 743, and the Swedish patent application SE 0002005-7. As a contrast to these three patents, the invention focuses on how a light weight protection shall be designed to affect the overturn and deformation of the projectile on a minimal penetration depth, at the same time as subsequent projectiles shall be able to hit the same entrance whole without any significant deterioration of the function of the protection, at the same time as the protection shall be able to be a sub-element of a larger building construction.

The procedure according to the present invention is not limited to any specific form of protection, except that a frame 1 or similar with accompanying panels delimits the intermediate layer from the surroundings. The shape may e.g. be a wall, a plane or a pipe shape according to FIGS. 1*a*-1*d* that protects existing house walls or alternatively erects new swiftly mountable wall constructions 9.

Figure 1F:
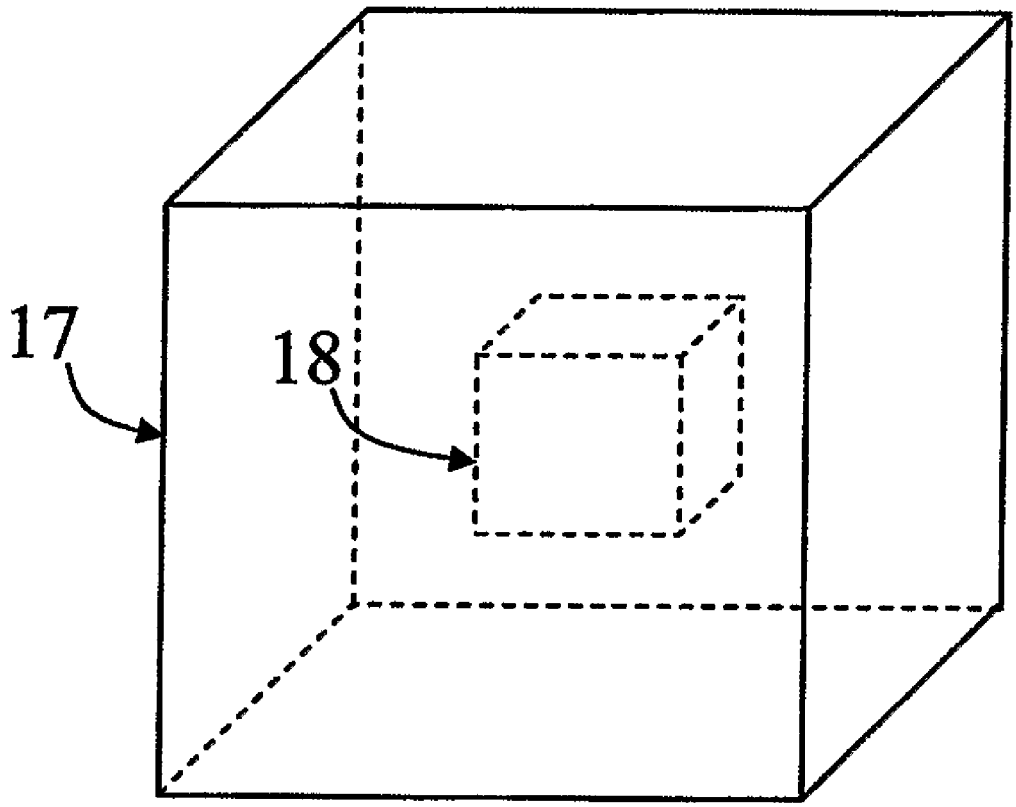
FIG. 1*f* A schematic overview of a package wrapping formed as a ballistic protection.

Other embodiments find their natural area of use as for example package wrappings 17, according to FIG. 1*f* wherein packed fragile objects such as for example vibration-sensitive electronics shall be protected. In the package related protections all sides can be perceived as front panels 2, as described in connection with FIG. 1*a*. The intermediate layer in these package wrappings is designed to protect the object that is surrounded by a traditional vibration absorbing package 18 that is not intended for protection against projectiles.

Figure 2A:
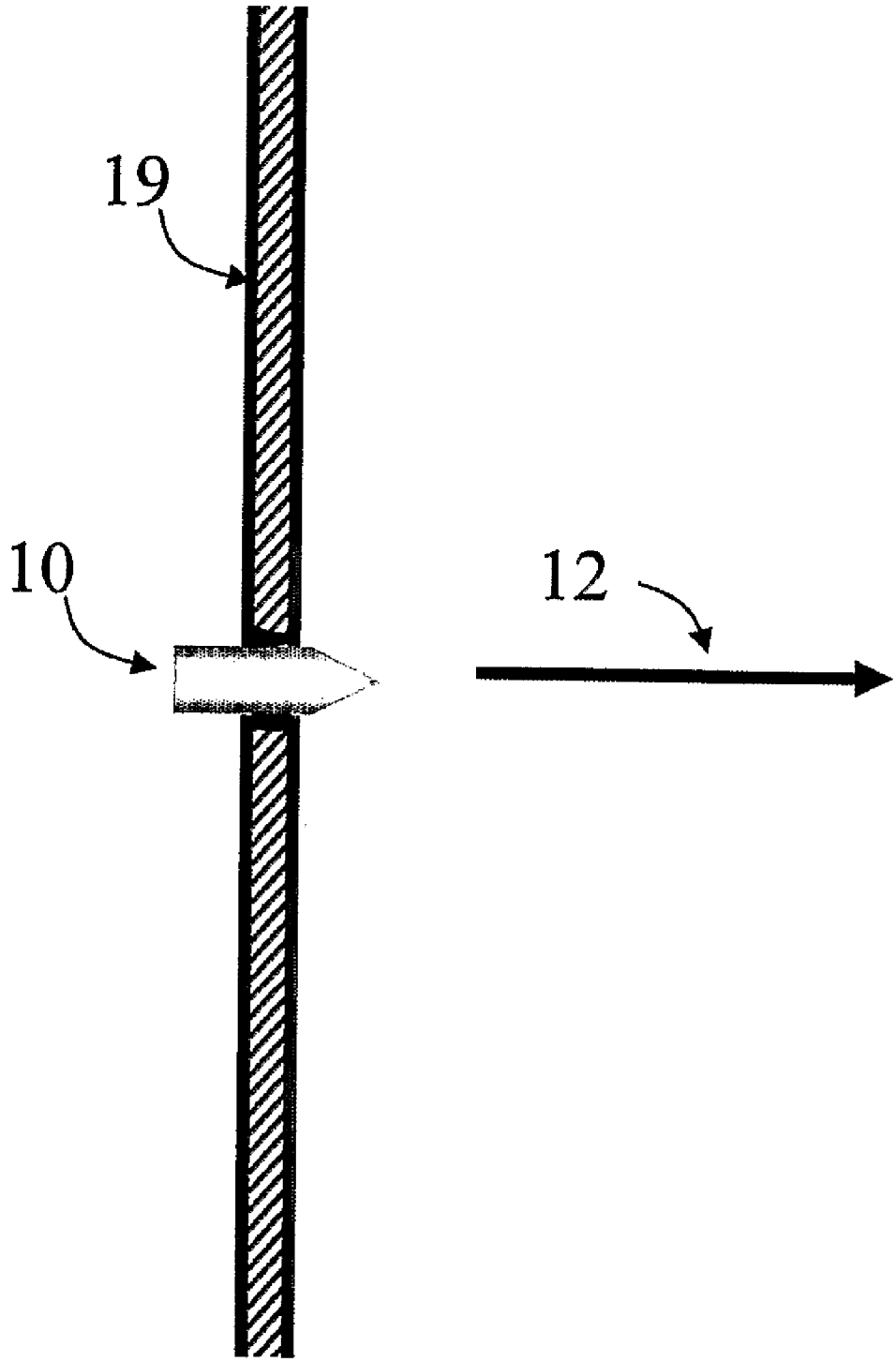
FIG. 2*a* A penetrating projectile in a simple front panel.

According to the invention the front panel according to FIG. 2*a* can have different functions. However, the simplest function is that the projectile 10, which can be both blunt or sharp depending on the type of ammunition, penetrates the surface 19 of the front panel without significantly altering its track 12 or its kinetic energy. The front panel can be flat or pipe-shaped and made off plastic, wood or a metal sheet or combinations thereof. In this case the front panel only works as a supporting construction for the underlying intermediate layers. Absorption of the main part of the kinetic energy from the projectile is assumed to occur in the intermediate layers and in the rear panel, unless a pipe shape protection is not intended.

Figure 2B:
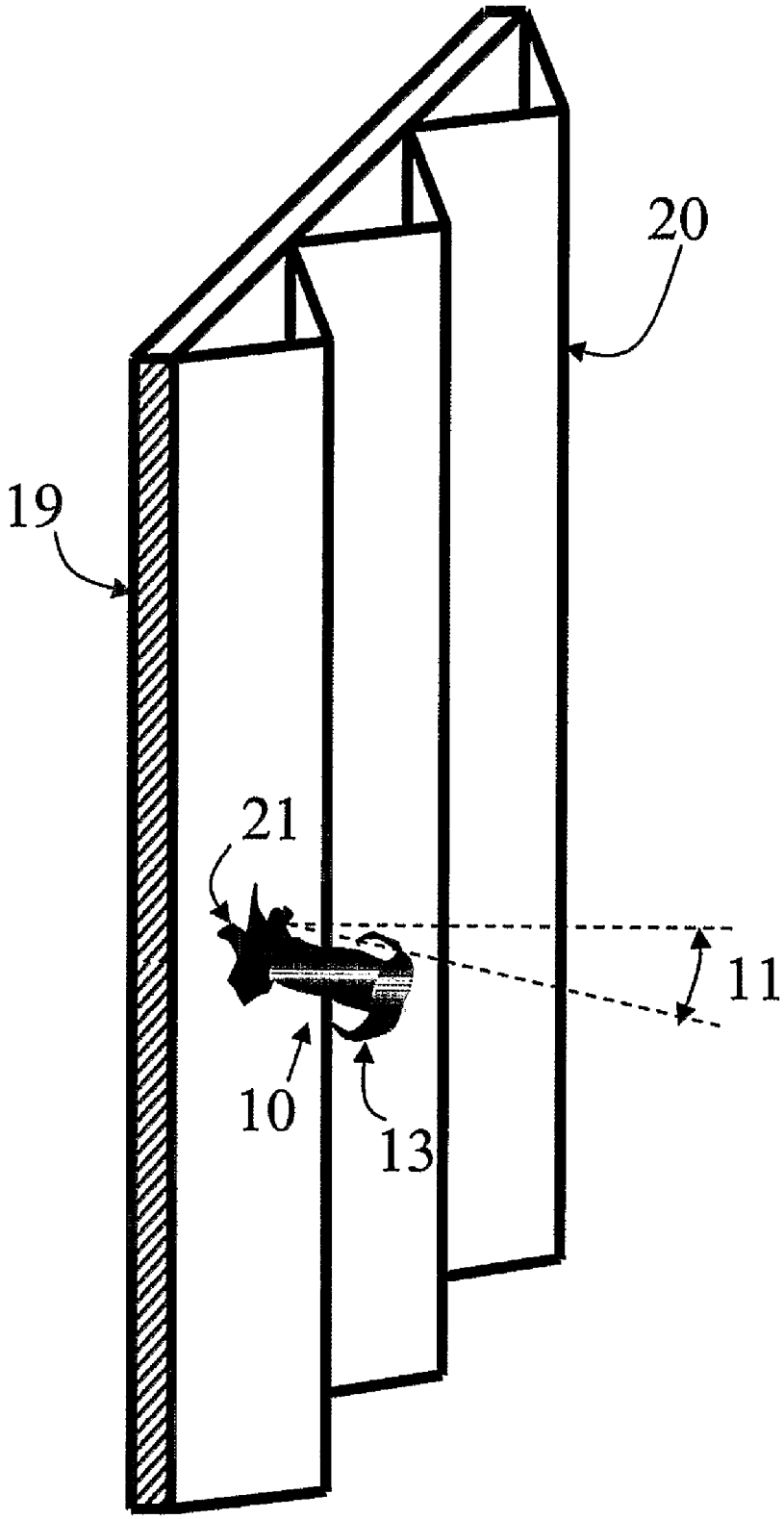
FIG. 2*b* A front panel comprising a surface with an underlying corrugated surface that is penetrated by a projectile.

A more developed front panel comprises, according to FIG. 2*b*, a surface 19 with an underlying corrugated metal surface 20, which will receive a ripped open hole 21 when the projectile penetrates the surface. FIG. 2*b* shows a flat construction, however the construction can assume a curved form as well. The purpose is to facilitate the first overturn 11 of the projectile 10 at the same time as projectiles with a tip shall be deformed 13 before they arrive into the intermediate layer. Naturally, the front panel can comprise a corrugated, flat or curved metal surface only but the outer layer of the front panel is often supplemented by a flat surface for esthetic reasons.

Figure 2C:
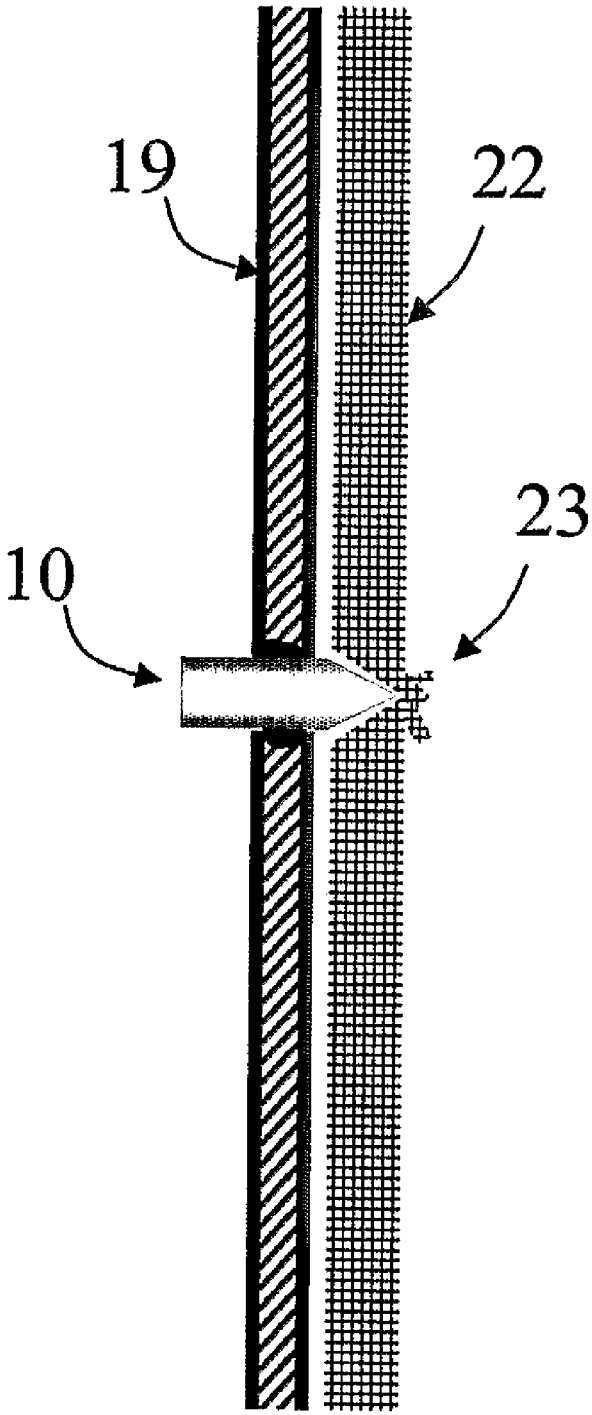
FIG. 2*c* A front panel with an underlying smooth and soft fiber web, which deaccelerate the projectile.

Another type of structure for the front panel according to FIG. 2*c* comprises a plan or curved surface 19, however with an underlying smooth and soft fiber fabric 22 the purpose of which is to follow the projectile 10 and thereby reduce its kinetic energy before the fiber fabric 23 breaks due to tension, i.e. only projectile deacceleration without deforming of the tip of the projectile is presupposed with this solution. However, the deacceleration in itself enables the initial overturn of the projectile since it becomes more instable when it loses kinetic energy.

Figure 2D:
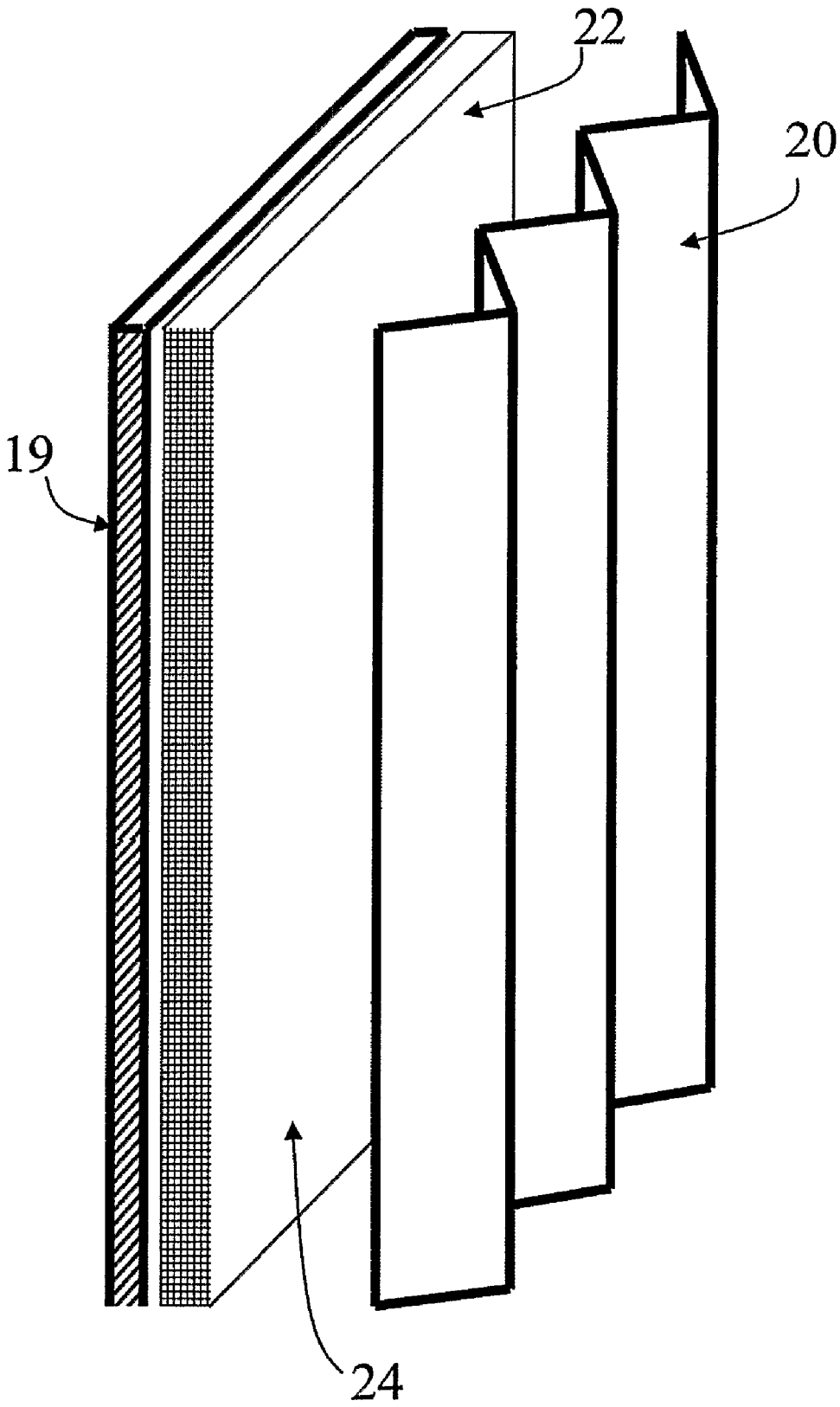
FIG. 2*d* A front panel comprising a surface with an underlying fiber fabric arranged in front of a corrugated metal surface.

Another type of front panel is illustrated in FIG. 2*d*, which comprises a flat or curved surface 19 with an underlying fiber fabric 22 that is placed in front of an underlying corrugated metal surface 20. The purpose with this design is that the projectile should be maximally deaccelerated before it hits the corrugated surface, which initiates the first projectile deformation and thereby accelerates the overturn process. Hence, the soft fiber material is expanding in the direction of movement for the projectile before the material is ripped apart, while the corrugated metal surface is penetrated by the projectile almost immediately after the hit whereby the projectile overturns and/or receives a different traveling direction. This requires an air column 24 between the fabric and the corrugated surface.

Figure 2E:
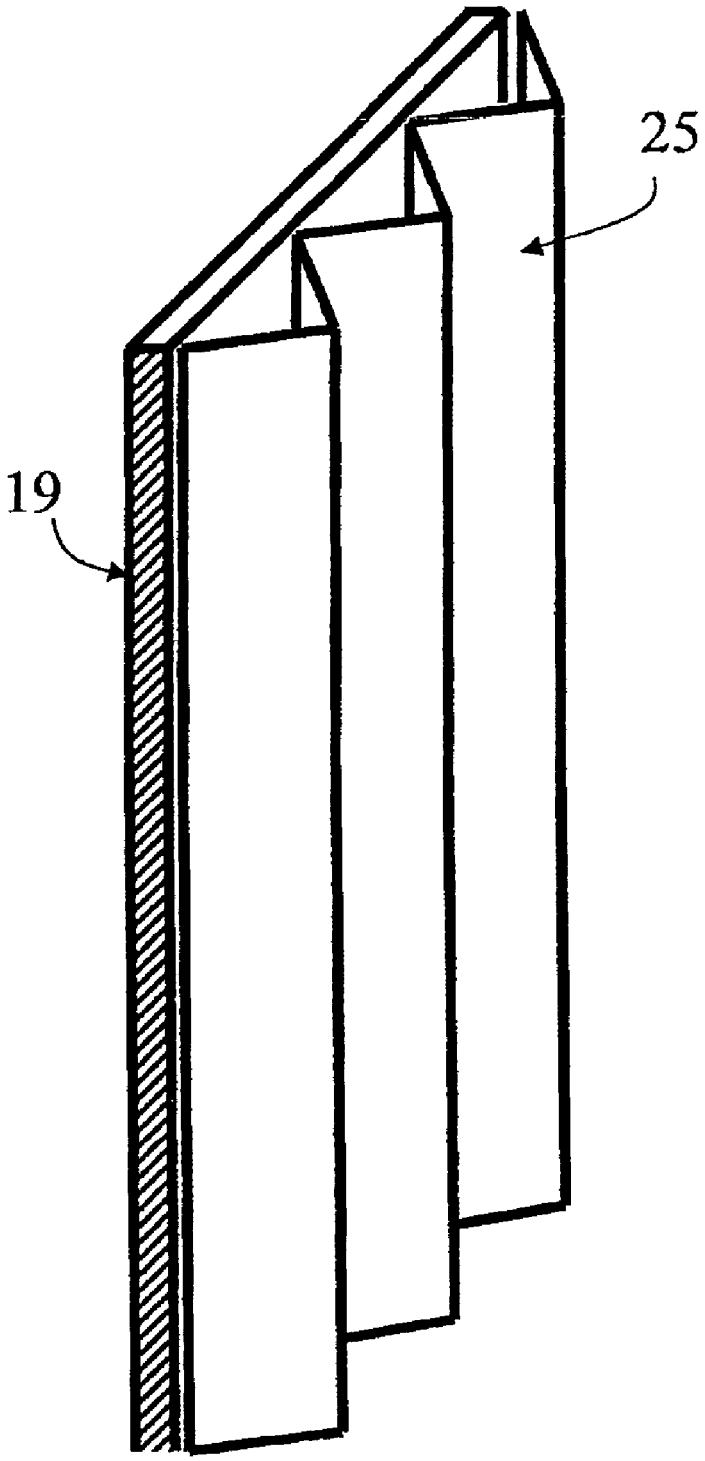
FIG. 2*e* A front panel comprising a surface with an underlying corrugated fiber web.

FIG. 2*e* shows another type of developed front panel that comprises a flat or curved surface 19, however with an underlying corrugated soft fiber fabric 25 with the purpose to follow the projectile 10. The variable drag tension in the corrugated fabric can be utilized to initiate an overturn of the projectile already before a penetration of the fiber fabric. The corrugated structure can be a fabric of for example polythene fiber or another material with a large tensional ability.

Combinations of the structures described above are also conceivable depending on the protection needed and the specific projectile caliber.

It should be emphasized that the front panel do usually not stop projectiles that hit in the same entrance hole. For these situations the intermediate layer is optimized to further stimulate the overturn, deformation and fragmentation of the projectile and thereby impose a faster reduction of its kinetic energy.

Figure 3A:
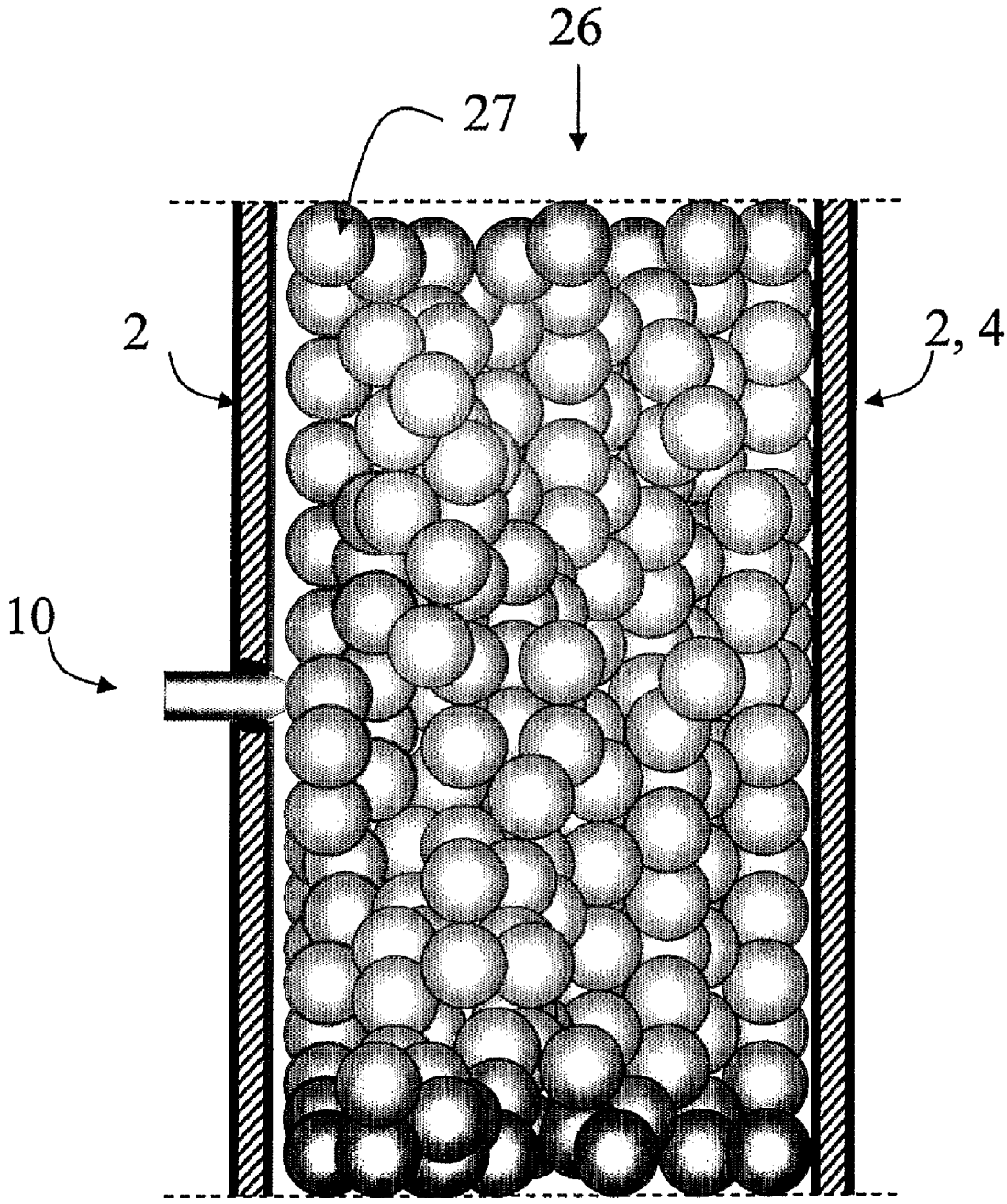
FIG. 3*a* A length section extending through a part of the ballistic protection, which visualizes an intermediate layer with granules.

According to an embodiment of the invention said intermediate layer in FIG. 3*a* is filled with granulate 26, for example ceramic or mineral materials that preferably have a grain size of about 5-10 millimeters, in the following also denoted granules 27. However, the grain size can vary depending on the choice of material and on the ammunition the protection is designed for. Specific materials that works well in different embodiments are stone, different ceramic materials such as $Al_2O_3$, $SiO_2$, $ZrO_2$, SiC, $Si_3N_4$ and mixtures or compositions of these. Glass and different hard polymers and hard polymer composites should also work well in various embodiments.

Figure 3B:
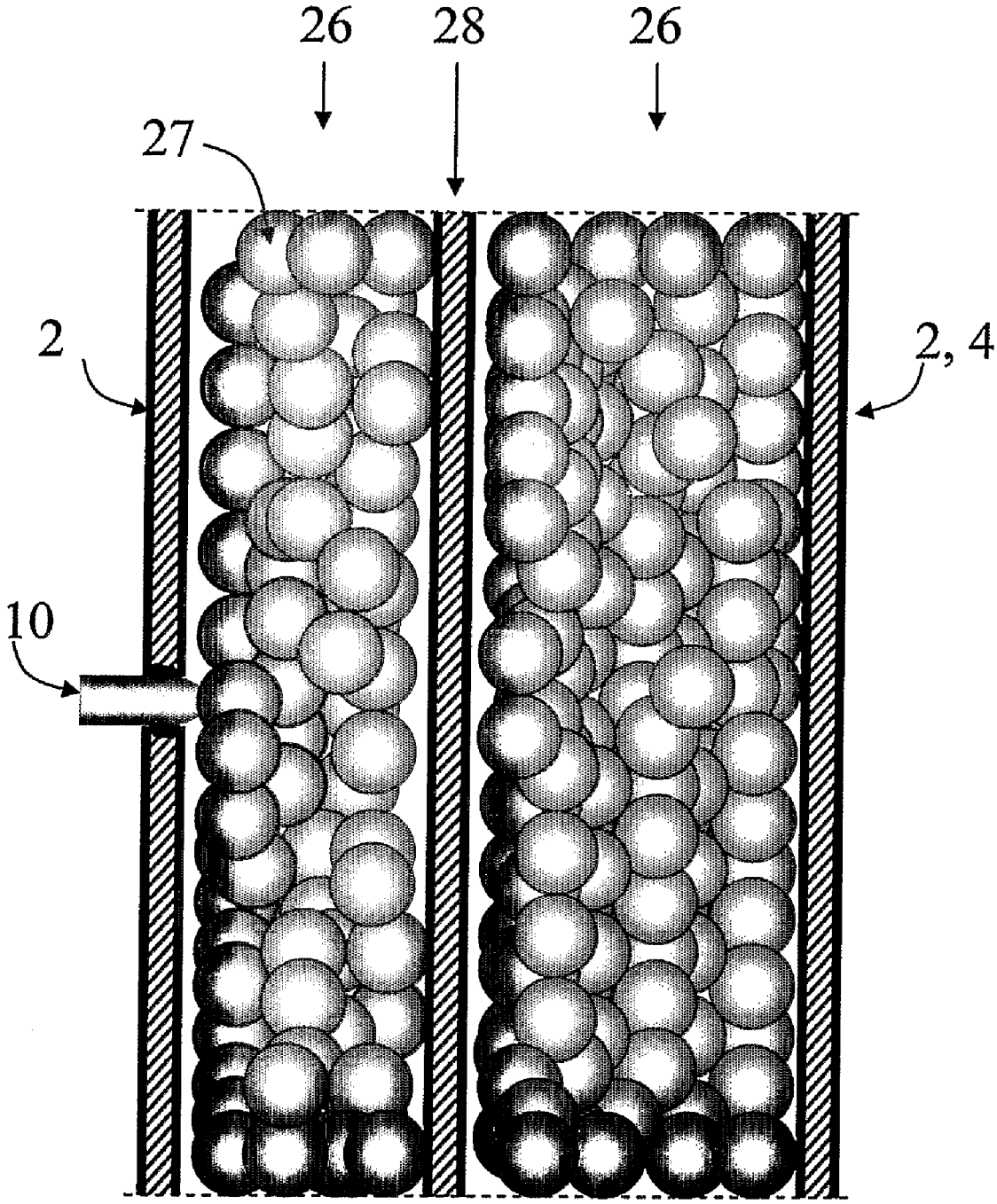
FIG. 3*b* A length section extending through a part of the ballistic protection, which visualizes an intermediate layer that is divided in two sections.

The intermediate layer, which usually has a thickness of about 50-300 millimeters, can be divided into several sections 28 according to FIG. 3*b*. The sections comprise granulate 26 adapted for their task to overturn, deform and deaccelerate the projectile alternatively it's fragments. At the same time the sections increase the protection stability, which is important if the protection should work both when several successive projectiles is penetrating the same entrance hole, and as a sub-element in building constructions 9 as described with reference to FIG. 1*b* and FIG. 1*c*.

Figure 3C:
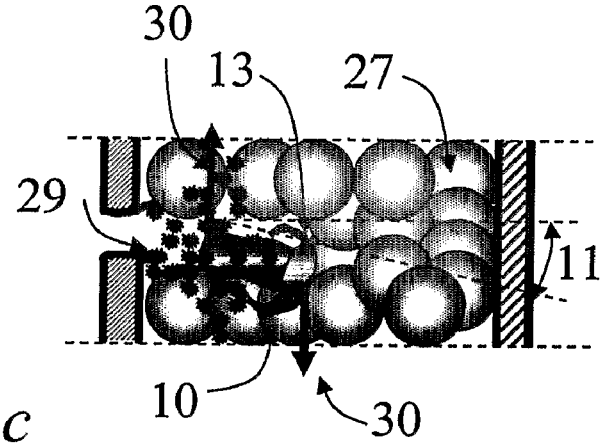
FIG. 3*c* A schematic image of how a projectile hits the granules in the intermediate layer and how the projectile is deformed and overturned at the same time as it crushes granules.
Figure 3D:
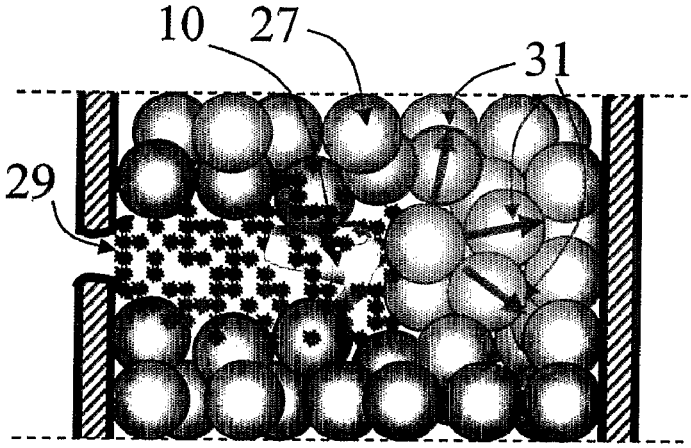
FIG. 3*d* A schematic image of how a projectile hits the granules in the intermediate layer and how the kinetic energy of the projectile is absorbed by the adjacent granules and how the forces are distributed with a subsequent energy dissipation as a consequence.
Figure 3E:
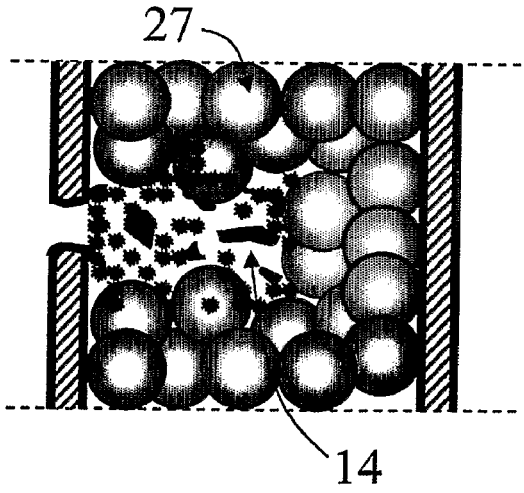
FIG. 3*e* A schematic image of how fragments of a projectile hits the granules in the intermediate layer.

According to the invention the granulate 26 is placed in the intermediate layer. The granules 27 are not fixated or oriented in any specific manner in the intermediate compartment according to FIG. 3*a* and FIG. 3*b*, e.g. spatially fixated by means of a surrounding plastic mass or liquid as in U.S. Pat. No. 3,431,818 and FR 2 649 743. Instead, the volume that is not occupied by the granules is preferably filled by air or some other gas or similar thin medium, which enables a direct contact between adjacent granules. This direct contact between the granules is strongly preferred to correctly distribute and absorb the kinetic energy from the projectile. The ability to overturn 11, deform 13, fragment 14 and change the direction 15 of the projectile according to FIG. 1*e* on a minimal penetration depth is increased.

a) according to FIG. 3*c* through an effective deformation 13 of the projectile 10 at the hit of the first granule that is crushed 29, which brings about a change of the centre of gravity with leads to an increased projectile instability and thereby an subsequent overturn 11. If the projectile is already deformed by the impact on the front panel this will only lead to that a subsequent hit on the first granule accelerates the instability procedure;

b) according to FIG. 3*c* through that the granules 27 is crushed and spread in the intermediate layer. This enables the resulting forces 30 that affect the projectile 10 to accelerate the overturn 11. This is due to the fact that the density of air is considerably low and thereby non-stabilizing, in particular compared to other materials such as plastic mass or water, which have a considerable higher density. The kinetic energy of the projectile itself is hereby utilized to facilitate the overturn, which increases the impact surface of the projectile with respect to subsequent granules. In cases where the projectile obtains a rotation around its own axis 16 the overturn at impact on a granule will be accelerated further by a received gyro effect;

c) in that the kinetic energy of the projectile is distributed by energy loss to the granule 27 that is hit according to FIG. 3*d*, i.e. energy loss in the form of energy dissipation in the projectile 10, and remaining kinetic energy if the projectile is not fully stopped at the first hit. The granule that is crushed 29 by the projectile is connected by contact to other adjacent granules that will be exposed to impulses—i.e. to forces 31 that must not necessarily be identical—with a subsequent energy dissipation as a consequence when the granule in question is hit. If the projectile after an initial hit on a granule still has a kinetic energy it will be distributed in a similar way at the subsequent granule hit. The energy will not be transferred to adjacent granules in the same way in a thicker medium such as a plastic mass or a liquid;

d) in that the granules are extremely hard with a selected brittleness. This usually causes such a large deformation of the projectile, as shown in FIG. 3*e*, so as to scattered the projectile into several smaller fragments 14 when the projectile has hit a number of granules. Naturally, this increases the possibility of the adjacent granules to absorb the reduced kinetic energy of the fragments.

Figure 3F:
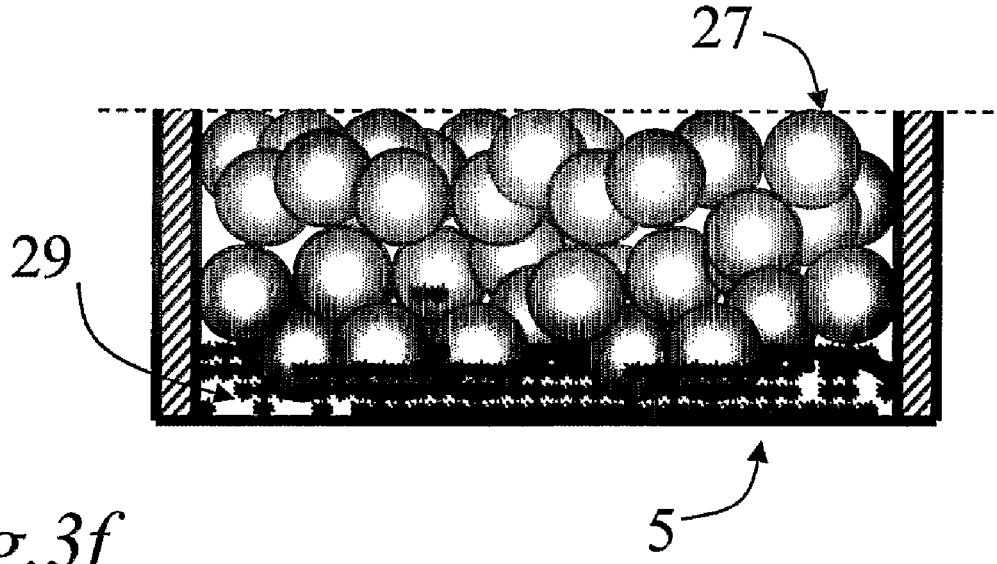
FIG. 3*f* A schematic image of how a projectile hits the granules in the intermediate layer, which shows how the crushed material from the granules through moving by their own weight becomes laying on the inside of the bottom panel.

The invention does not fixate the granules 27 in the compartment and the possibility of deaccelerate subsequent projectiles that penetrates the front panel through same entrance hole is therefore increased. This is due to the fact that the crushed granulate 29, which through their own weight is transported down to i.a. the bottom panel 5, is replaced by "down-flowing" new granules that fills the possible holes that have been caused by earlier projectiles, see FIG. 3*d* and FIG. 3*f*.

The granules can have different shapes so as to quickly being transported by their own weight to areas that previously had material that has now been crushed. The surface of the granules shall preferably have a low friction so as to facilitate a movement to areas wherein a preceding projectile has crushed previous material.

According to the invention the hardness of the granules can vary in a direction towards the center of the granule, which can then be used in an optimal way for the overturning and deacceleration of the projectile. The design of the granule to be chosen is closely related to the type of projectile that should be handled by the protection.

Figure 3G:
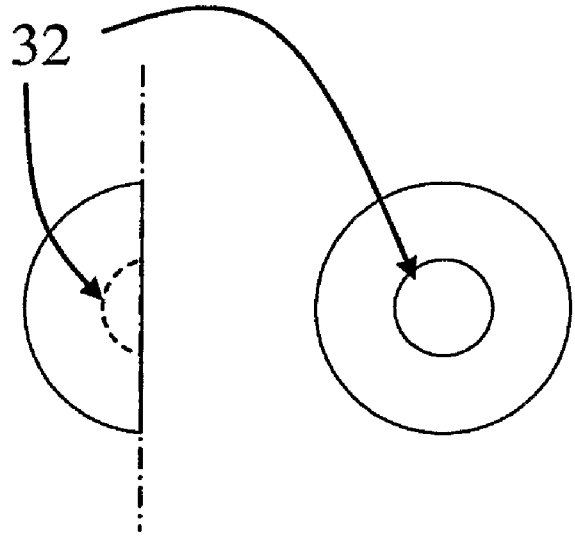
FIG. 3*g* Shows a granule with a hollow core.

The granules can be designed with a hollow core 23 according to FIG. 3*g* so as to facilitate the overturn when the projectile hits the surface of the casing, or alternatively designed as homogenous so as to deform and/or scatter and deaccelerate the projectiles.

According to the invention different kinds of granules can cooperate. A much preferred component is spherical granules, however even material shaped as prolate or oblate spherical ellipsoids may occur. Even cylindrical and tetrahedral granules are conceivable, but will often lead to an increased weight for the protection at the same time as movements can be hindered of its shape, which is not preferred from a functional perspective.

If the intermediate layer is built from several subsequent sections the first layer can e.g. comprise granules with a hollow core to facilitate the overturn process, since the volume of crushed material is reduced and thereby increasing the free volume that can be used for the overturn of the projectile. The layer can also comprise homogenous granules depending of the structure and purpose of the protection. The subsequent layers can comprise homogenous granules for a final absorption of the kinetic energy of the projectile.

According to an embodiment of the invention the different sections comprising granules can be delimited by e.g. a metal sheet or alternatively a fabric of e.g. polythene fiber or some other material with a large stretching ability.

Figure 3H:
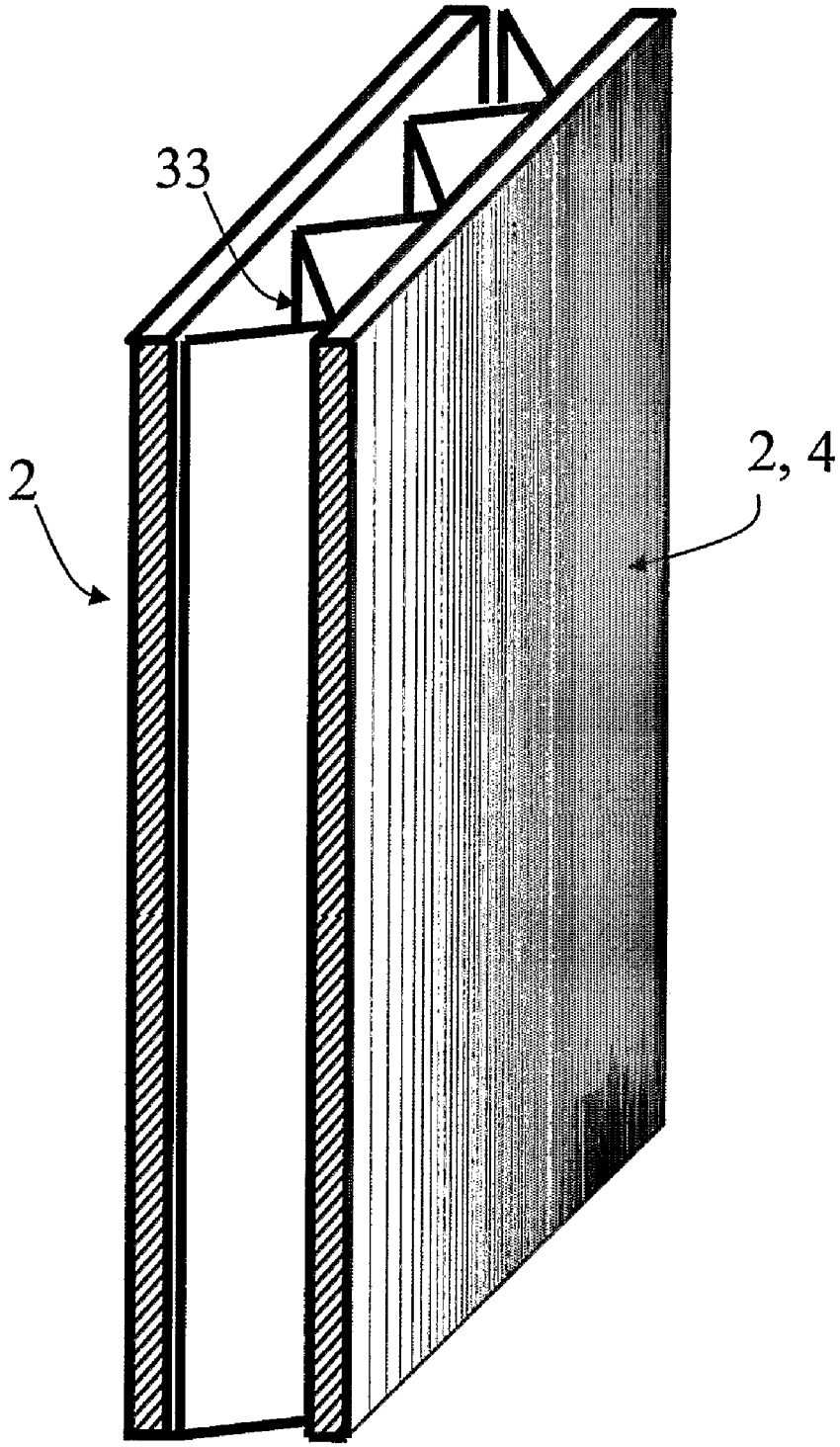
FIG. 3*h* A perspective view obliquely from the front of a ballistic protection with a corrugated structure that delimits the intermediate layer in two sections.

According to an embodiment of the invention the different delimiting sections according to FIG. 3*h* can be arranged so that a corrugated structure 33 is achieved. This structure has a shape such that a maximum deformation and overturning effect for the already unstable projectile is achieved, by that the energy dissipation of the granules are deflected further away from the initial traveling path of the projectile.

Figure 3I:
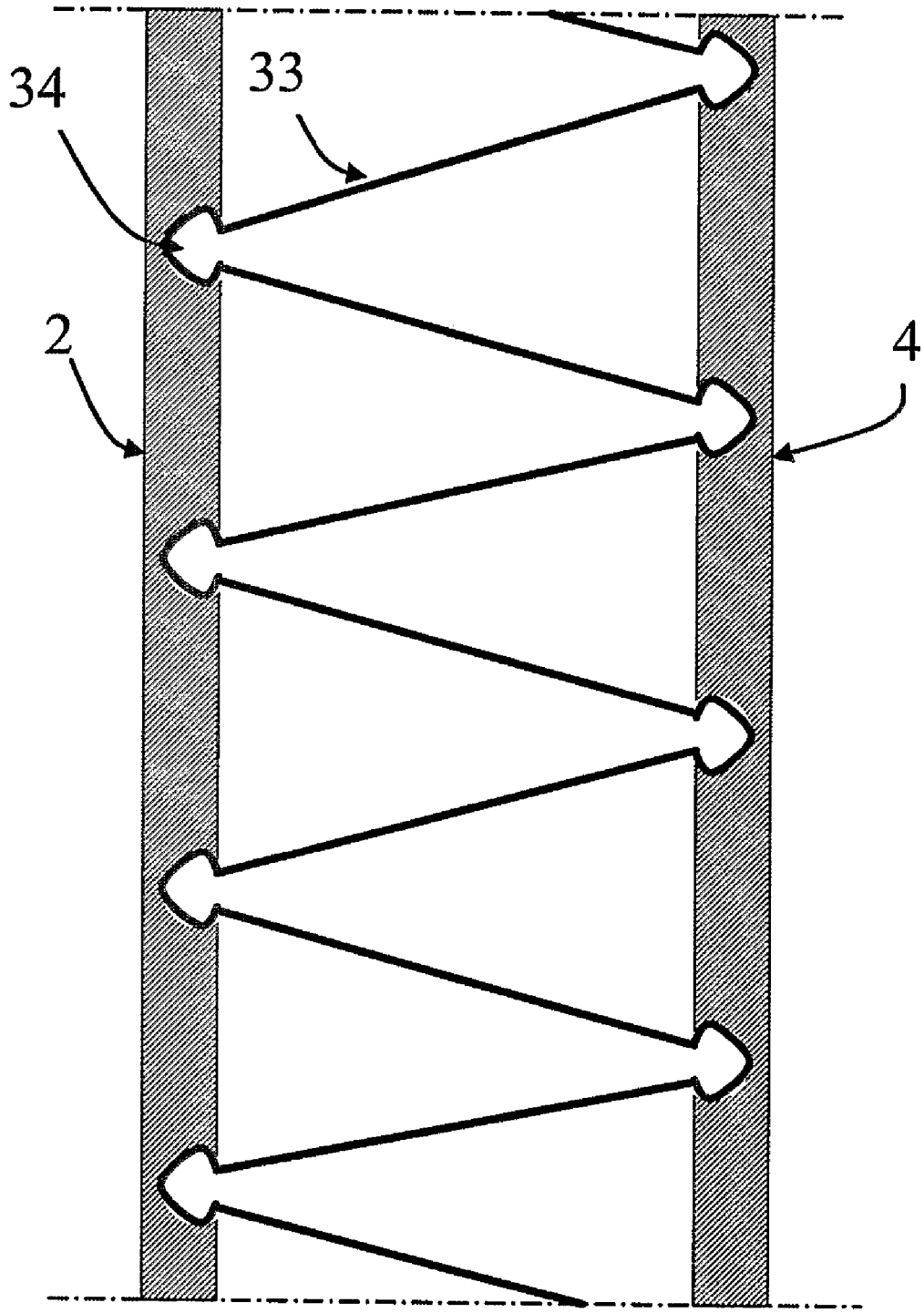
FIG. 3*i* A length section through a part of the ballistic protection, which describes how the corrugated metal surface in the intermediate layer can be fastened in the front and rear panels respectively.

According to an embodiment of the invention in FIG. 3*i* the elements that binds alternatively fastens 34 the front panel and the rear panel 4 can also have a corrugated surface 33, e.g. a corrugated metal sheets can be inserted in such a way that the static pressure of the granule filling can be accommodated without any particular deformation of the front and the rear panels. Naturally, the corrugated surface 33 can also be fastened by bolts or by some other solution.

According to an embodiment of the invention the rear panel can also be optimized and if thin protections shall be manufactured it is preferred that the rear panel consists of a flat glass fiber surface covered with aramide fiber alternatively polythene fiber or some other suitable fiber material with a large stretching ability.

According to an embodiment of the invention the rear panel can also be manufactured as a front panel. The purpose with this solution is that some applications require protections with double entrance walls, i.e. front panels 2, see FIG. 3*h*. However, here thicker intermediate layers are often required to prevent a through penetration by the projectile. The protections can also be manufactured with two rear panels according to the above. The protections will be suitably used in e.g. landscaped offices wherein walls shall be installed quickly and provide protection from two directions.

According to the invention the above protection will also find other applications, since it can be designed for maximum sound isolation. In these cases the protection is manufactured with two front panels of acoustic plates of e.g. compressed mineral wool in a similar way as in FIG. 3*h*. The intermediate layer can be designed according to the above, alternatively by other materials with another dimension adapted for sound with a specific wavelength.

The method or embodiment according to the present invention is not limited to any of the above embodiments or examples, but is related to protections against projectiles from hand firearms, scatter and hand grenades. The protection is a design with at least one front panel that admit the projectile to pass under deacceleration with limited deformation, change of direction and overturning as a consequence and without causing ricochets. Since the intermediate layers comprise non-fixated granules the projectile will be forced to hit surfaces and thereby being deformed, overturned, fragmented and forced to change direction with the purpose to further accomplish maximal reduction of kinetic energy. At the same time, subsequent projectiles can hit the same entrance hole since the granules arranged above the previously crushed granules will fall downwards due to their own weight. The protection also comprises a rear panel that finally stops the projectile and alternatively works as a front panel if the protection is optimized for projectile penetration from two directions. An example of the later is walls and other delimiters in landscaped offices.

The protection also comprises a bottom panel, at least two side panels (unless pipe shaped constructions are used) and an upper panel that enables an assembling of the construction as a part of a larger building structure.

The invention claimed is:

1. Protection for stopping objects comprising:

an enclosure adapted so that the object can penetrate the enclosure within at least one area; and at least one intermediate layer comprising granules arranged within the enclosure, a plurality of the granules in the intermediate layer have a hardness that varies in different parts of the granule, which intermediate layer and enclosure are arranged to deaccelerate the object, wherein the granules are movable arranged with respect to each other, the space in the intermediate layer that is not occupied by granules is filled by a gas medium to enable contact between adjacent granules, the granules have mechanical properties so that a granule is crushed and spread in the intermediate layer when the granule is hit by the object, at the same time as adjacent granules are subjected to impulses with a subsequent energy dissipation so that the object and fragments thereof remains in the protection with a reduced risk for ricochets.

2. Protection according to claim 1, wherein the granules have mechanical properties so that a granule is crushed and spread in the intermediate layer when the granule is hit by an object comprising projectiles from fire arms or scatter from grenades.

3. Protection according to claim 1, wherein a plurality of the granules in the intermediate layer have a surface friction that facilitates movement of new granules to areas wherein an object has crushed the granules that were previously occupying the area.

4. Protection according to claim 3, wherein a plurality of the granules in the intermediate layer are made of a ceramic or mineral material, which when crushed by an impacting object give the object a change in the centre of gravity with a subsequent increased instability that assist an overturn and fragmentation of the object.

5. Protection according to claim 3, wherein the shape of a plurality of the granules in the intermediate layer is substantially similar to a symmetrical or asymmetrical sphere, or a prolate or oblate spherical ellipsoid so as to assist a mutual movement between the granules to maximize the energy dissipation of an object or fragments of an object impacting the granules.

6. Protection according to claim 1, wherein a plurality of the granules in the intermediate layer are made of a ceramic or mineral material, which when crushed by an impacting object give the object a change in the centre of gravity with a subsequent increased instability that assist an overturn and fragmentation of the object.

7. Protection according to claim 1, wherein the shape of a plurality of the granules in the intermediate layer is substantially similar to a symmetrical or asymmetrical sphere, or a prolate or oblate spherical ellipsoid so as to assist a mutual movement between the granules to maximize the energy dissipation of an object or fragments of an object impacting the granules.

8. Protection according to claim 1, further comprising a rear panel made of a fiber material.

9. Protection according to claim 8, wherein the fiber material comprises a glass fiber surface covered with aramide fiber or polythene fiber.

10. Protection according to claim 1, wherein an underlying tensile layer is arranged behind the surface of the enclosure.

11. Protection according to claim 10, wherein an underlying space column is arranged behind the tensile layer.

12. Protection according to claim 10, wherein the underlying tensile layer has a corrugated structure.

13. Protection for stopping objects comprising:

an enclosure adapted so that the object can penetrate the enclosure within at least one area; and at least one intermediate layer comprising granules arranged within the enclosure, a plurality of the granules in the intermediate layer have a hollow core, which intermediate layer and enclosure are arranged to deaccelerate the object, wherein the granules are movable arranged with respect to each other, the space in the intermediate layer that is not occupied by granules is filled by a gas medium to enable contact between adjacent granules, the granules have mechanical properties so that a granule is crushed and spread in the intermediate layer when the granule is hit by the object, at the same time as adjacent granules are subjected to impulses with a subsequent energy dissipation so that the object and fragments thereof remains in the protection with a reduced risk for ricochets.

14. Protection according to claim 13, wherein the granules have mechanical properties so that a granule is crushed and spread in the intermediate layer when the granule is hit by an object comprising projectiles from fire arms or scatter from grenades.

15. Protection according to claim 13, wherein a plurality of the granules in the intermediate layer have a surface friction that facilitates movement of new granules to areas wherein an object has crushed the granules that were previously occupying the area.

16. Protection according to claim 13, wherein a plurality of the granules in the intermediate layer are made of a ceramic or mineral material, which when crushed by an impacting object give the object a change in the centre of gravity with a subsequent increased instability that assist an overturn and fragmentation of the object.

17. Protection according to claim 13, wherein the shape of a plurality of the granules in the intermediate layer is substantially similar to a symmetrical or asymmetrical sphere, or a prolate or oblate spherical ellipsoid so as to assist a mutual movement between the granules to maximize the energy dissipation of an object or fragments of an object impacting the granules.

18. Protection according to claim 13, further comprising a rear panel made of a fiber material.

19. Protection according to claim 18, wherein the fiber material comprises a glass fiber surface covered with aramide fiber or polythene fiber.

20. Protection according to claim 13, wherein an underlying tensile layer is arranged behind the surface of the enclosure.

21. Protection according to claim 20, wherein an underlying space column is arranged behind the tensile layer.

22. Protection according to claim 20, wherein the underlying tensile layer has a corrugated structure.

* * * * *